US008844542B2

(12) United States Patent
Irving et al.

(10) Patent No.: US 8,844,542 B2
(45) Date of Patent: Sep. 30, 2014

(54) LOCK-IN COSMETIC ACCESSORY SLEEVE APPARATUS HAVING ENGAGEABLE FASTENER AND/OR PRESSURE MEANS

(71) Applicants: Katie Marguerite Irving, New Paltz, NY (US); Timothy Martin Irving, Otisville, NY (US)

(72) Inventors: Katie Marguerite Irving, New Paltz, NY (US); Timothy Martin Irving, Otisville, NY (US)

( * ) Notice: Subject to any disclaimer, the term of this patent is extended or adjusted under 35 U.S.C. 154(b) by 1 day.

(21) Appl. No.: 13/748,075

(22) Filed: Jan. 23, 2013

(65) Prior Publication Data

US 2013/0125922 A1 May 23, 2013

Related U.S. Application Data

(63) Continuation-in-part of application No. 12/927,748, filed on Nov. 23, 2010, now Pat. No. 8,550,096.

(51) Int. Cl.
*A45D 40/24* (2006.01)
*B05C 1/00* (2006.01)

(52) U.S. Cl.
CPC ..... *A45D 40/24* (2013.01)
USPC ..... 132/317; 401/17

(58) Field of Classification Search
USPC ..... 132/218, 317, 318; 401/16–19, 23–25, 401/34
See application file for complete search history.

(56) References Cited

U.S. PATENT DOCUMENTS 3,002,611 A * 10/1961 Doblin ..... 401/78
3,186,416 A * 6/1965 Kolts ..... 401/179
3,592,202 A 7/1971 Jones
3,690,777 A 9/1972 Costa
4,840,511 A 6/1989 Fattori et al.
5,040,914 A * 8/1991 Fitjer ..... 401/127
5,044,523 A * 9/1991 McNab ..... 222/207
5,832,942 A * 11/1998 Gutberlet ..... 132/317
6,241,408 B1 6/2001 Lang
6,276,853 B1 8/2001 Breidenbach et al.
6,637,963 B2 10/2003 Huang
6,702,494 B2 3/2004 Dumler et al.
8,550,096 B2 * 10/2013 Irving et al. ..... 132/318

OTHER PUBLICATIONS

Mark. Magalog 12 '10 Campaigns 24 & 25, Mark. 1251 Avenue of the Americas, NY, NY, 10020, Copyright 2010 Avon Products, Inc. No. 77513-9, pp. 7, 30-33.

* cited by examiner

*Primary Examiner* — Robyn Doan
(74) *Attorney, Agent, or Firm* — Aziz M. Ahsan; Ahsan & Associates, PLLC

(57) ABSTRACT

The present invention relates generally to a cosmetic apparatus. More particularly, the invention encompasses an accessory sleeve for a cosmetic item. The present invention is also directed to a novel lock-in cosmetic accessory sleeve. The accessory sleeve has a first opening to securely and releaseably accommodate a first cosmetic container, and a second opening to securely and releaseably accommodate a second cosmetic container. Both the accessory sleeve and the containers have releaseable engagement means to securely hold each to the other. The lock-in cosmetic accessory sleeve has at least one partitioning wall having at least one protrusion having at least one spring means to exert pressure on one end of the cosmetic container. The cosmetic container preferably has at least two chambers, wherein the first chamber accommodates cosmetic contents, while the second chamber is used to accommodate at least one engageable fastener.

20 Claims, 3 Drawing Sheets

LOCK-IN COSMETIC ACCESSORY SLEEVE APPARATUS HAVING ENGAGEABLE FASTENER AND/OR PRESSURE MEANS

CROSS-REFERENCE TO RELATED APPLICATION

The instant patent application is a Continuation-In-Part of pending U.S. patent application Ser. No. 12/927,748, filed on Nov. 23, 2010, titled "LOCK-IN COSMETIC ACCESSORY SLEEVE APPARATUS" the entire disclosure of which pending patent application is incorporated herein by reference.

FIELD OF THE INVENTION

The present invention relates generally to a cosmetic apparatus. More particularly, the invention encompasses an accessory sleeve, for a cosmetic item. The present invention is also directed to a novel, lock-in cosmetic accessory sleeve. The accessory sleeve has a first opening to securely and releaseably accommodate a first cosmetic container, and a second opening to securely and releaseably accommodate a second cosmetic container. Both the accessory sleeve and the containers have releaseable engagement means to securely hold each to the other. The lock-in cosmetic accessory sleeve has at least one partitioning wall having at least one protrusion having at least one spring means to exert pressure on one end of the cosmetic container. The cosmetic container preferably has at least two chambers, wherein the first chamber accommodates cosmetic contents, while the second chamber is used to accommodate at least one engageable fastener.

BACKGROUND INFORMATION

The cosmetic industry is a vibrant industry with innovations and inventions. It is a multi-billion dollar market where every new improvement not only promotes a product but also leads to other innovations. There are numerous patents that have been obtained by the innovators of this industry, however, there are always new inventions that keep this industry moving forward.

U.S. Pat. No. 2,710,614 (Murray Dulbers), the entire disclosure of which is incorporated herein by reference, discloses an invention comprising a duplex rotary holder for personal use, and more particularly to a holder for personal use designed to closely unite two rotary holders, each of which being capacitated to carry an element related in use to the other.

U.S. Pat. No. 3,043,316 (Mary E. Bolser), the entire disclosure of which is incorporated herein by reference, discloses an invention which relates to an applicator for applying nail polish to one's fingernails. More particularly it relates to a compact applicator for dispensing a controlled amount of fluid into a brush.

U.S. Pat. No. 4,840,511 (Joseph E. Fattori, et al.), the entire disclosure of which is incorporated herein by reference, discloses an invention comprising a roll-on applicator package having a container for storing a fluid such as a perfume or lotion or an antiperspirant or deodorant composition, an elongated roller supported on stub axles near the container top for dispensing the fluid and a resilient cap having attached therein a resilient liner for sealing the container. The resilient liner is preferably an elastomeric material and has a Durometer measurement of 20-35 Shore A.

U.S. Pat. No. 5,492,248 (Georg Ortner, et al), the entire disclosure of which is incorporated herein by reference, discloses an invention comprising a perfume dispenser having a cylindrical shape similar to a pencil. A clip at the covering cap is broad and suitable for affixing advertising or jewelry, and may be slipped over the edge of a pocket, from which only the clip protrudes. The perfume dispenser has a delivery device including a pump, small sponge or a roll-on mechanism, which attaches to a glass cylinder. The covering cap is fastened by slipping it onto the perfume container, and a locking connection is provided between the cap and the perfume container. To compensate for tolerances, the covering cap can connect onto a metal mounting of the delivery device, for example, onto a screw cap. Alternatively, in a plug-in connection, the covering cap is provided with a slit in the edge region of a plug-in opening, or the covering cap may include a metal outer sleeve and an elastically deformable plastic inner sleeve. To improve seating of the cap, the inner sleeve includes ribs, which protrude inwards, extending in the longitudinal direction and having elastic, properties.

U.S. Pat. No. 5,586,694 (Diane Breidenbach, et al.), the entire disclosure of which is incorporated herein by reference, discloses an invention comprising a perfume dispenser which is provided with a clear replaceable refill cartridge. The perfume applicator includes a metal or plastic barrel, screw on cap and disposable replaceable refill cartridge. The refill cartridge acts as the case of the unit and liquid perfume is dispensed from a snap-in spring loaded applicator, such as a roll-on applicator or an atomizer spray applicator. The disposable refill cartridge screws into the base of the barrel and a clear plug portion of refill cartridge allows viewing of the perfume level to determine when the unit is empty. The replaceable perfume cartridge preferably includes a threaded neck portion with a roller ball applicator portion therein, wherein the threaded neck portion is closed by a threaded metal cap. The replaceable perfume cartridge also preferably includes a transparent base end to provide an indication of the amount of perfume left in the cartridge, wherein further the transparent base portion is adjacent to a threaded base collar which engages a reciprocal threaded interior end of a plastic sleeve within the metal exterior barrel.

U.S. Pat. No. 6,702,494 (Norbert Dumler, et al.), the entire disclosure of which is incorporated herein by reference, discloses an invention comprising a cosmetic unit comprising two different applicators each with a stem, each of the applicators dipping into a respective reservoir; each reservoir having an externally threaded neck on which to screw a coupling member; and the two reservoirs being releasably attachable to each other via a coupling sleeve by means of the coupling members which are screwed on and which simultaneously serve as a closure cap. The coupling members in the form of screw caps are non-rotarily attachable to the coupling sleeve by an axial serration and axially tightly attachable thereto by a beaded section engaging with a locking groove.

However, there is a need for improvement in the cosmetic accessories arena, and this invention improves on the deficiencies of the prior art, and provides a novel lock-in cosmetic accessory sleeve apparatus.

PURPOSES AND SUMMARY OF THE INVENTION

The invention is a novel lock-in cosmetic accessory sleeve apparatus having engageable fastener and/or pressure means.

Therefore, one purpose of this invention is to provide a novel lock-in cosmetic accessory sleeve apparatus having engageable fastener and/or pressure means.

Another purpose of this invention is to provide a reliable solution for accommodating at least two cosmetic accessories within one sleeve-type cosmetic apparatus having engageable fastener and/or pressure means.

Yet another purpose of this invention is to provide an easy solution for removably locking, carrying, and locating at least one cosmetic accessory having engageable fastener and/or pressure means.

Therefore, in one aspect this invention comprises a lock-in cosmetic accessory sleeve apparatus comprising:

(a) a lock-in cosmetic accessory sleeve having a first open end and a second open end, at least one inner wall between said first open end and said second open end, an outer wall, and at least one sleeve engageable means;

(b) a first cosmetic accessory having at least one first engageable means, said first cosmetic accessory comprising a first container, said first container haying a first dispensing means for the passage of at least one first material, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container, said second container having a second dispensing means for the passage of at least one second material, and wherein at least a portion of said second cosmetic accessory is releaseably secured to at least a portion of said inner wall of said lock-in cosmetic accessory sleeve through said second open end;

(d) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve; and (e) said at least one inner wall between said first open end and said second open end having at least one first protrusion facing said first open end, and wherein said first protrusion having at least one first spring-like means, and thereby forming said lock-in cosmetic accessory sleeve apparatus.

In another aspect this invention comprises a lock-in cosmetic accessory sleeve apparatus comprising:

(a) a cosmetic accessory having at least one first engageable means, said cosmetic accessory comprising a container, said container having at least one dispensing means for the passage of at least one first material, and wherein at least a portion of said cosmetic accessory is releaseably secured to at least a portion of an inner wall of a lock-in cosmetic accessory sleeve through an open end;

(b) at least one inner wall between said at least one dispensing means and a base of said cosmetic accessory, and forming a chamber, said chamber having at least one first opening, and at least one second opening, and wherein said first opening being directly opposite said second opening; and (c) at least one engageable fastener, and wherein said engageable fastener having an engageable button connected to an engageable base via at least one spring-like means, and wherein said engageable button is securely and engageable secured within said first opening in said chamber, and wherein said engageable base is secured within said second opening in said chamber, such that said engageable button forms said at least one first engageable means.

In yet another aspect this invention comprises a lock-in cosmetic accessory sleeve apparatus comprising:

(a) a lock-in cosmetic accessory sleeve having a first open end and a second open end, at least one inner wall between said first open end and said second open end, an outer wall, and at least one sleeve engagable means;

(b) a first cosmetic accessory having at least one first engageable means, said first cosmetic accessory comprising a first container, said first container having a first dispensing means for the passage of at least one first material, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container, said second container having a second dispensing means for the passage of at least one second material, and wherein at least a portion of said second cosmetic accessory is releaseably secured to at least a portion of said inner wall of said lock-in cosmetic accessory sleeve through said second open end;

(d) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve;

(e) said at least one inner wall between said first open end and said second open end having, at least one first protrusion facing said first open end, and wherein said first protrusion having at least one first spring-like means;

(f) at least one inner wall between said at least one dispensing, means and a base of said first cosmetic accessory, and forming at least one first chamber, said first chamber having at least one first chamber opening, and at least one second chamber opening, and wherein said first chamber opening is directly opposite said second chamber opening; and (g) at least one engageable fastener, and wherein said engageable fastener having an engageable button connected to an engageable base via at least one spring-like means, and wherein said engageable button is securely and engageable secured within said first chamber opening in said chamber, and wherein said engageable base is secured within said second chamber opening in said chamber, such that said engageable button forms said at least one first engageable means.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1:
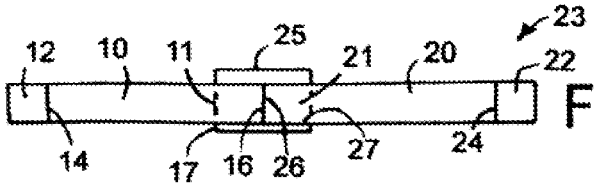
FIG. 1 illustrates a side-view of a first embodiment of a lock-in cosmetic accessory sleeve invention.

FIG. 1 illustrates a side-view of a first embodiment of a lock-in cosmetic accessory sleeve invention or apparatus 23. The lock-in cosmetic accessory sleeve invention 23, or "Fresh Kiz" 23, comprises of at least one first cosmetic accessory or container 10, which can be removably secured to at least one lock-in cosmetic accessory sleeve or carrier 25. The lock-in cosmetic accessory sleeve 25, preferably has at least one first opening 11, at a first end 17, of the lock-in cosmetic accessory sleeve 25. The lock-in cosmetic accessory sleeve 25, could also have at least one second opening 21, at a second end 27, of the lock-in cosmetic accessory sleeve 25. The lock-in cosmetic accessory sleeve invention 23 or "Fresh Kiz" 23, could also have at least one second cosmetic accessory or container 20, which can be removably secured to the at least one lock-in cosmetic accessory sleeve 25. It is preferred that the openings 11, 21, are of such a nature that they can securely accommodate the insertion and securing thereof of either the first cosmetic accessory 10, or the second cosmetic accessory 20. The first cosmetic accessory 10, preferably comprises of an open end or a first dispensing means 14, a closed end or wall 16, and a cover or cap or lid 12. The second cosmetic accessory 20, preferably comprises of an open end or a second dispensing means 24, a closed end or wall 26, and a cover or cap or lid 22. It should be appreciated that the cover or cap or lid 12, 22, could be any cover or cap or lid 12, 22, which are well-known in the art, such as, for example, a cover or cap or lid having internal threads, or having a snap-on type features, or having all internal sleeve that engages with the outer surface of the container 10, 20, to name a few.

Figure 2:
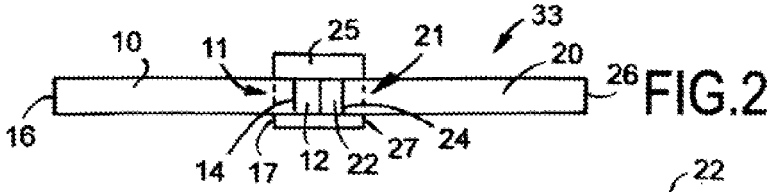
FIG. 2 illustrates a side-view of a second embodiment of a lock-in cosmetic accessory sleeve invention.

FIG. 2 illustrates a side-view of a second embodiment of a lock-in cosmetic accessory sleeve invention or apparatus 33. The lock-in cosmetic accessory sleeve invention 33, is similar to the lock-in cosmetic accessory sleeve invention 23, except that at least a portion of the cover or cap or lid 12, 22, is inside at least a portion of the lock-in cosmetic accessory sleeve 25, and is securely held therein. As one can see in this embodiment the closed end or wall 16, 26, are on the outside of the lock-in cosmetic accessory sleeve 25, and at the opposite ends.

Figure 3:
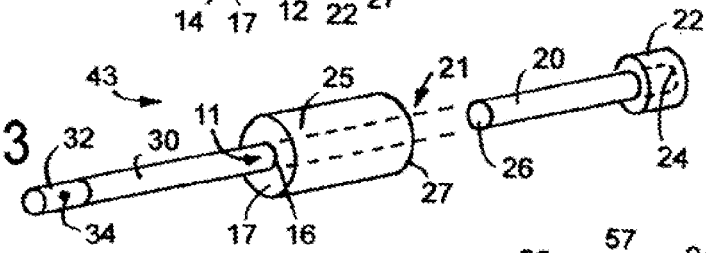
FIG. 3 illustrates an exploded perspective view of a third embodiment of a lock-in cosmetic accessory sleeve invention.
Figure 4:
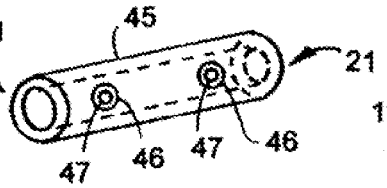
FIG. 4 illustrates a perspective view of a fourth embodiment of a lock-in cosmetic accessory sleeve invention.

FIG. 3 illustrates an exploded perspective view of a third embodiment of a lock-in cosmetic accessory sleeve invention or apparatus 43. The lock-in cosmetic accessory sleeve invention 43, is similar to the lock-in cosmetic accessory sleeve invention 23, except that the cosmetic accessory or container 30, has a fluid delivery device 34, in the cover or cap or lid portion 32. The fluid delivery device 34, could be an atomizer spray head 34, a push button type outlet nozzle 34, a spray mechanism 34, to name a few FIG. 4 illustrates a perspective view of a fourth embodiment of a lock-in cosmetic accessory sleeve invention where a lock-in cosmetic accessory sleeve 45, comprises at least one opening 46, to accommodate at least one engaging means 47. The at least one engaging means 47, could be selected from a group comprising, a ball, a ball bearing, a solid protruding material, a male-type protrusion, to name a few. It should be appreciated that the opening 46, is a through opening such that the engaging means 47, protrudes through both the inside surface or plane of the lock-in cosmetic accessory sleeve 45, as well as the outside surface or the plane of the lock-in cosmetic accessory sleeve 45. The engaging means 47, could also be a button-type lock and release 47.

Figure 5:
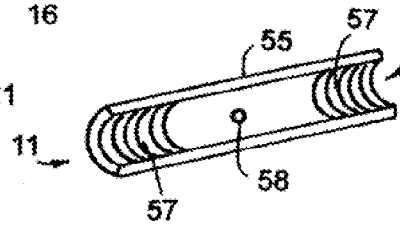
FIG. 5 illustrates a cut-away perspective view of a fifth embodiment of a lock-in cosmetic accessory sleeve invention.

FIG. 5 illustrates a cut-away perspective view of a fifth embodiment of a lock-in cosmetic accessory sleeve invention where a lock-in cosmetic accessory sleeve 55, comprises at least one engaging area 57. The at least one engaging area 57, could be internal threads 57, or internal, grooves 57. The lock-in cosmetic accessory sleeve 55, could optionally have at least one opening 58, to allow for air movement, especially, for any release of air pressure when the cosmetic accessory 10, 20, is being inserted into the lock-in cosmetic accessory sleeve 55.

Figure 6:
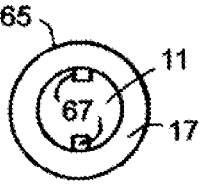
FIG. 6 illustrates an end view of a sixth embodiment of a lock-in cosmetic accessory sleeve invention.

FIG. 6 illustrates an end view of a sixth embodiment of a lock-in cosmetic accessory sleeve invention where a lock-in cosmetic accessory sleeve 65, comprises at least one engaging area 67. The at least one engaging area 67, could be at least one locking teeth 67, or at least one locking rib 67. As one can see that the cross-sectional area of the first end 17, is larger than the cross-sectional area of the first opening 11. The cross-sectional area of the opening is comparable to the cross-sectional area of the first container 10, or the second container 20, as it has to be slightly bigger to accommodate the insertion of the first container 10, or the second container 20, into the first opening 11.

Figure 7:
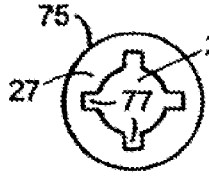
FIG. 7 illustrates an end view of a seventh embodiment of a lock-in cosmetic accessory sleeve invention.

FIG. 7 illustrates an end view of a seventh embodiment of a lock-in cosmetic accessory sleeve invention where a lock-in cosmetic accessory sleeve 75, comprises at least one engaging, area 77. The at least one engaging area 77, could be at least one locking channel 77, or blind hole 77.

Figure 8:
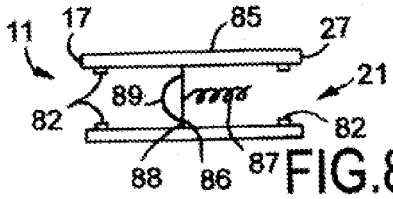
FIG. 8 illustrates a cut-away side-view of an eighth embodiment of a lock-in cosmetic accessory sleeve invention.

FIG. 8 illustrates a cut-away side-view of an eighth embodiment of a lock-in cosmetic accessory sleeve invention where a lock-in cosmetic accessory sleeve 85, comprises at least one engaging wall 86. The engaging wall 86, could have secured thereto at least one first spring 87. The engaging wall 86, could have secured thereto at least one second spring 89, such that the first spring 87, and the second spring 89, are on the opposite wall surface of the engaging wall 86. The lock-in cosmetic accessory sleeve 85, could also have at least one locking teeth or rib or bump, or protrusion 82. The wall 86, of the lock-in cosmetic accessory sleeve 85, could optionally have at least one opening 86, to allow for air movement, especially, for any release of air pressure when the cosmetic accessory 10, 20, is being inserted into the lock-in cosmetic accessory sleeve 85.

Figure 9:
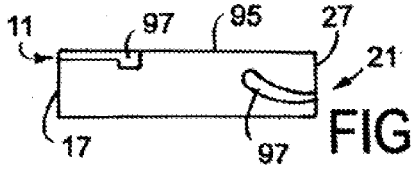
FIG. 9 illustrates a side-view of a ninth embodiment of a lock-in cosmetic accessory sleeve invention.

FIG. 9 illustrates a side-view of a ninth embodiment of a lock-in cosmetic accessory sleeve invention where a lock-in cosmetic accessory sleeve 95, comprises at least one engaging area 97. The at least one engaging area 97, could be selected from a group comprising at least one locking channel 97, a blind hole channel 97, a bayonet-type channel 97, a curved-shaped engaging channel 97, to name a few.

Figure 10:
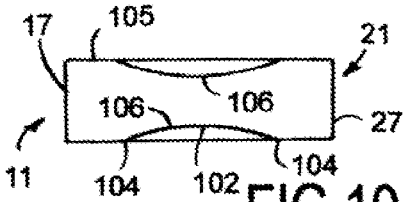
FIG. 10 illustrates a side-view of a tenth embodiment of a lock-in cosmetic accessory sleeve invention.

FIG. 10 illustrates a side-view of a tenth embodiment of a lock-in cosmetic accessory sleeve invention where a lock-in cosmetic accessory sleeve 105, comprises at least one engaging wall 106. The engaging wall 106, is shaped such that it is thickest at a first location 102, and thinner at a second location 104, where the second location 104, is closer to at least the first surface 17, or the second surface 27.

Figure 11:
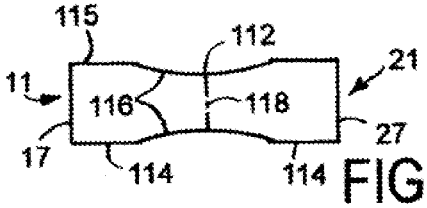
FIG. 11 illustrates a side-view of an eleventh embodiment of a lock-in cosmetic accessory sleeve invention.

FIG. 11 illustrates a side-view of an eleventh embodiment of a lock-in cosmetic accessory sleeve invention where a lock-in cosmetic accessory sleeve 115, composes at least one engaging wall 116. The engaging wall 116, is shaped such that it has a first cross-sectional area at a first location 112, and second cross-sectional area at a second location 114, such that the first cross-sectional area 112, is different than the second cross-sectional area 114. It is preferred that the first cross-sectional area 112, is smaller than the second cross-sectional area 114. For some applications the lock-in cosmetic accessory sleeve 115, could also have at least one wall 118. It is preferred that the wall 118, is in the first cross-sectional area 112.

Figure 12:
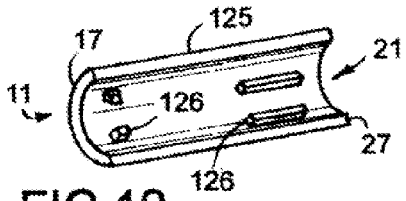
FIG. 12 illustrates a cut-away perspective view of a twelfth embodiment of a lock-in cosmetic accessory sleeve invention.

FIG. 12 illustrates a cut-away perspective view of a twelfth embodiment of a lock-in cosmetic accessory sleeve invention where a lock-in cosmetic accessory sleeve 125, comprises at least one engaging area 126. The at least one engaging area 126, could be at least one locking teeth 126, or at least one locking rib 126.

Figure 13:
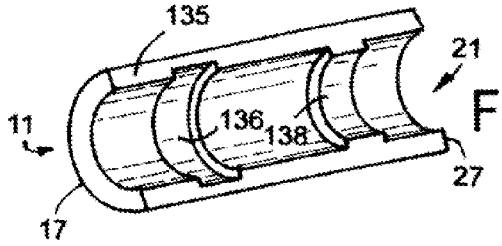
FIG. 13 illustrates a cut-away perspective view of a thirteenth embodiment of a lock-in cosmetic accessory sleeve invention.

FIG. 13 illustrates a cut-away perspective view of a thirteenth embodiment of a lock-in cosmetic accessory sleeve invention where a lock-in cosmetic accessory sleeve 135, comprises at least one first engaging area 136. The at least one first engaging area 136, could be at least one locking channel or blind hole 136. The lock-in cosmetic accessory sleeve 135, could also comprise of at least one second engaging area 138. The at least one second engaging area 138, could be at least one locking channel or locking protrusion 138.

Figure 14:
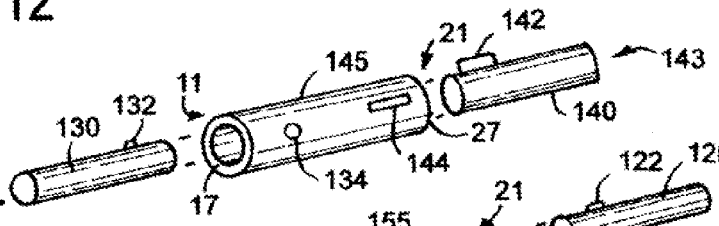
FIG. 14 illustrates an exploded perspective view of a fourteenth embodiment of a lock-in cosmetic accessory sleeve invention.

FIG. 14 illustrates an exploded perspective view of a fourteenth embodiment of a lock-in cosmetic accessory sleeve invention 143. The lock-in cosmetic accessory sleeve invention 143, is similar to the lock-in cosmetic accessory sleeve invention 23, except that the cosmetic accessory or container 130, has at least one engaging mechanism 132. The at least one engaging mechanism 132, could be selected from a group comprising an engaging protrusion 132, a ball bearing 132, a protruding surface 132, to name a few. The lock-in cosmetic accessory sleeve invention 143, could also have a second cosmetic accessory or container 140, having at least one engaging mechanism 142. The at least one engaging mechanism 142, could be selected from a group comprising an engaging protrusion 142, a teeth protrusion 142, a ribbed protrusion 142, a protruding surface 142, to name a few. The lock-in cosmetic accessory sleeve 145, could also have at least one first engaging area 134, to securely engage and accommodate the engaging, mechanism 132. Similarly, the lock-in cosmetic accessory sleeve 145, could also have at least one second engaging area 144, to securely engage and accommodate the engaging mechanism 142. The engaging mechanism 132, 142, could also be a button-type lock and release mechanism 132, 142.

Figure 15:
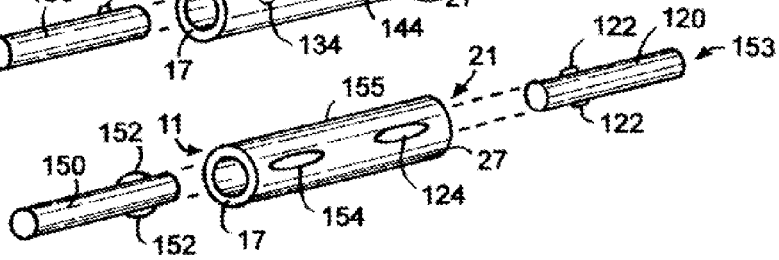
FIG. 15 illustrates an exploded perspective view of a fifteenth embodiment of a lock-in cosmetic accessory sleeve invention.

FIG. 15 illustrates an exploded perspective view of a fifteenth embodiment of a lock-in cosmetic accessory sleeve invention 153. The lock-in cosmetic accessory sleeve invention 153, is similar to the lock-in cosmetic accessory sleeve invention 23, except that the cosmetic accessory or container 150, has at least one engaging mechanism 152. The at least one engaging mechanism 152, could be selected from a group comprising an engaging spring 152, a raised strip 152, to name a few. The lock-in cosmetic accessory sleeve invention 153, could also have a second cosmetic accessory or container 120, having at least one engaging mechanism 122. The at least one engaging mechanism 122, could be selected from a group comprising an engaging protrusion 122, a wing-type protrusion 122, a wing-ribbed-type protrusion 122, to name a few. The lock-in cosmetic accessory sleeve 155, could also have at least one first engaging area 154, to securely engage and accommodate the engaging mechanism 152. Similarly, the lock-in cosmetic accessory sleeve 155, could also have at least one second engaging area 124, to securely engage and accommodate the engaging mechanism 122.

Figure 16:
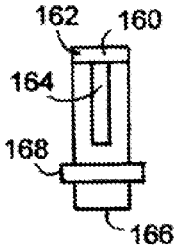
FIG. 16 illustrates a side-view of a sixteenth embodiment of a lock-in cosmetic accessory sleeve invention.

FIG. 16 illustrates a side-view of a sixteenth embodiment of a lock-in cosmetic accessory sleeve invention where a cosmetic accessory or container 160, has at least one engaging surface 168, and a base 166. The at least one engaging surface 168, could be at least one locking channel 168, or a locking protrusion 168. The cosmetic accessory or container 160, could also have a cap or cover 162, having at least one cosmetic accessory 164, secured thereto. The at least one cosmetic accessory 164, could be selected from a group comprising, a lipstick 164, an eye pencil 164, an eye liner 164, a chap stick 164, a deodorant stick 164, a perfume stick 164, to name a few.

Figure 17:
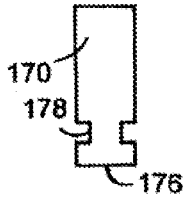
FIG. 17 illustrates a side-view of a seventeenth embodiment of a lock-in cosmetic accessory sleeve invention.

FIG. 17 illustrates a side-view of a seventeenth embodiment of a lock-in cosmetic accessory sleeve invention where a cosmetic accessory or container 170, has at least one engaging surface 178, and a base 176. The at least one engaging surface 178, could be at least one locking channel 178, or a blind channel 178, to name a few.

Figure 18:
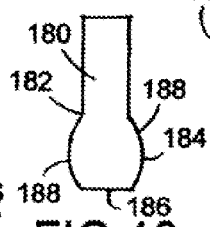
FIG. 18 illustrates a side-view of an eighteenth embodiment of a lock-in cosmetic accessory sleeve invention.

FIG. 18 illustrates a side-view of an eighteenth embodiment of a lock-in cosmetic accessory sleeve invention where a cosmetic accessory or container 180, has at least one engaging surface 188, and a base 186. The at least one engaging surface 188, is shaped such that it has a first cross-sectional area at a first location 182, and second cross-sectional area at a second location 184, such that the first cross-sectional area 182, is different than the second cross-sectional area 184. It is preferred that the first cross-sectional area 182, is smaller than the second cross-sectional area 184.

Figure 19:
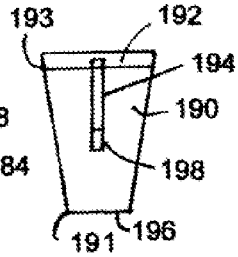
FIG. 19 illustrates a side-view of as nineteenth embodiment of a lock-in cosmetic accessory sleeve invention.

FIG. 19 illustrates a side-view of a nineteenth embodiment of a lock-in cosmetic accessory sleeve invention having a cosmetic accessory or container 190, with a base 196, where the cosmetic accessory 190, is shaped such that it has a first cross-sectional area at a first location 191, and second cross-sectional area at a second location 193, such that the first cross-sectional area 191, is different than the second cross-sectional area 193. It is preferred that the first cross-sectional area 191, is smaller than the second cross-sectional area 193. The cosmetic accessory or container 190, could also have a cap or cover 192, having at least one cosmetic support article or accessory 194, secured thereto. The at least one cosmetic support accessory 194, could also have at least one cosmetic applicator 198, secured thereto, where the cosmetic applicator 198, could be selected from a group comprising, a brush 198, a swab 198, a felt-type material 198, a scrubber 198, a to name a few.

Figure 20:
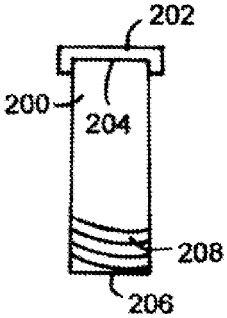
FIG. 20 illustrates a side-view of a twentieth embodiment of a lock-in cosmetic accessory sleeve invention.

FIG. 20 illustrates a side-view of a twentieth embodiment of a lock-in cosmetic accessory sleeve invention where a cosmetic accessory or container 200, has at least one engaging surface 208, and a base 206. The at least one engaging surface 208, could be at least one locking channel 208, or external threads 208, or external grooves 208. The cosmetic accessory or container 200, could also have a cap or cover 202, that can be snapably engaged to the peripheral edge or mouth 204, of the cosmetic accessory 200.

Figure 21:
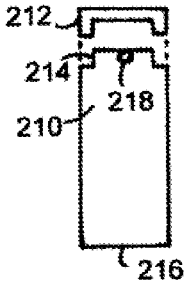
FIG. 21 illustrates an exploded side-view of a twenty-first embodiment of a lock-in cosmetic accessory sleeve invention.

FIG. 21 illustrates an exploded side-view of a twenty-first embodiment of a cosmetic accessory sleeve invention where a cosmetic accessory or container 210, has a base 216, and a cap or cover 212. The cosmetic accessory 210, could have roller 218; or a roll-on type mechanism 218, secured to the peripheral edge or mouth 214, of the cosmetic accessory or container 210. The roller 218, could be a roller-type ball 218, a cylindrical elongated roller 218, or any other similar device which can be used for dispensing fluids or material, such as, for example, cosmetic fluids or cosmetic material, from inside the container 210.

Figure 22:
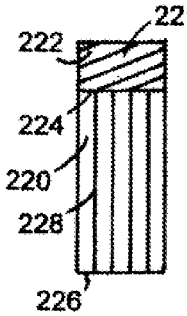
FIG. 22 illustrates a side-view of a twenty-second embodiment of a lock-in cosmetic accessory sleeve invention.

FIG. 22 illustrates a side-view of a twenty-second embodiment of a lock-in cosmetic accessory sleeve invention where a cosmetic accessory or container 220, has a base 226, and a cap or cover or lid 222. An area between the cap 222, and the container 220, defines an opening or mouth 224. The cap 222, has at least one channel or ridge 221, while the container 220, has at least one channel or ridge 228. The at least one channel or ridge 221, and/or the at least one channel or ridge 228, help in providing a non-smooth area for the easy opening and closing of the cap 222, and/or the container 220, of the lock-in cosmetic accessory 23.

Figure 23:
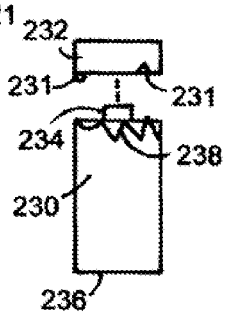
FIG. 23 illustrates an exploded side-view of a twenty-third embodiment of a lock-in cosmetic accessory sleeve invention.

FIG. 23 illustrates an exploded side-view of a twenty-third embodiment of a lock-in cosmetic accessory sleeve invention where a cosmetic accessory or container 230, has a base 236, and a cap or cover or lid 232. An area between the cap 232, and the container 230, defines an opening or mouth or dispensing means 234. The cap 232, along the peripheral portion of the cap 232, has at least one male or female engagement portion 231, while the container 230, along the peripheral portion of the container 230, has at least one male or female engagement portion 238. The male or female engagement portion 231 and 238, allow the secure engagement of the cap 232, with the container 230, around the opening 234.

Figure 24:
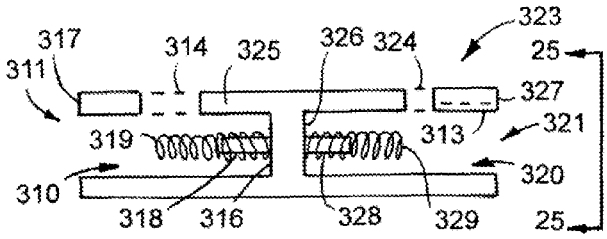
FIG. 24 illustrates a side-view of a twenty-fourth embodiment of a lock-in cosmetic accessory sleeve invention.

FIG. 24 illustrates a side cut-away view of a twenty-fourth embodiment of a lock-in cosmetic accessory sleeve invention or apparatus 321. The lock-in cosmetic accessory sleeve invention 323, or "Fresh Kiz" 323, could accommodate any of the at least one first cosmetic accessory or container as discussed earlier, such as, for example, cosmetic accessory or container 10, 20, shown in FIG. 1, which can be removably secured to at least one lock-in cosmetic accessory sleeve or carrier 325. The lock-in cosmetic accessory sleeve 325, preferably has at least one first sleeve opening 311, at a first end 317, of the lock-in cosmetic accessory sleeve 325. The lock-in cosmetic accessory sleeve 325, could also have at least one second sleeve opening 321, at a second end 327, of the lock-in cosmetic accessory sleeve 325. The lock-in cosmetic accessory sleeve invention 323, or "Fresh Kiz" 323, could also accommodate any of the at least one second cosmetic accessory or container as discussed earlier, such as, for example, container 10, 20, shown in FIG. 1, which can be removably secured to the at least one lock-in cosmetic accessory sleeve 325. It is preferred that the openings 311, 321, are of such a nature that they can securely accommodate the insertion and securing thereof of either the first cosmetic accessory 10, or the second cosmetic accessory 20, and easy removal thereof, when desired. The first cosmetic accessory 10, preferably comprises of an open end or a first dispensing means 14, a closed end or wall 16, and a cover or cap or lid 12. The second cosmetic accessory 20, preferably comprises of an open end or a second dispensing means 24, a closed end or wall 26, and a cover or cap or lid 22. The lock-in cosmetic accessory sleeve 325, further comprises at least one sectional wall having a first wall surface 316, and a second wall surface 326. The first wall surface 316, faces the first opening 311, and forms a first chamber 310, which is between the first wall surface 316, and the first opening 311, while, the second wall surface 326, faces the second opening 321, and forms a second chamber 320, which is between the second wall surface 326, and the second opening 321. The first wall surface 316, has at least one first pole or protrusion or male portion 318, to accommodate at least one first spring-like device 319, while, the second wall surface 326, has at least one second protrusion or pole or male portion 328, to accommodate at least one second spring-like device 329. The lock-in cosmetic accessory sleeve 325, further comprises at least one first hole or opening 314, and wherein the first hole or opening 314, is between the first wall surface 316, and the first end 317. Optionally, the lock-in cosmetic accessory sleeve 325, could also further comprise of at least one second hole or opening 324, and wherein the second hole or opening 324, is between the second wall surface 326, and the second end 327. For some applications the lock-in cosmetic accessory sleeve 325, could also have at least one internal engaging area 313, and wherein the at least one internal engaging area 313, preferably is between a wall surface or an opening, and an end, such as, for example, between the second wall surface 326, or opening 324, and the second end 327.

Figure 25:
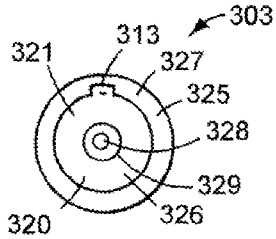
FIG. 25 illustrates an end-view of a twenty-fifth embodiment of a lock-in cosmetic accessory sleeve invention taken along 25-25 from FIG. 24.

FIG. 25 illustrates an end-view of a twenty-fifth embodiment of a lock-in cosmetic accessory sleeve invention or apparatus 303, taken along section 25-25 from FIG. 24. As one can see that the lock-in cosmetic accessory sleeve 325, has at least one internal engaging area 313, and wherein the at least one internal engaging area 313, preferably is between a wall surface or an opening, and an end, such as, for example, between the second wall surface 326, or opening 324, shown in FIG. 24, and the second end 327. The at least one internal engaging area 313, could be used for example, to guide the engaging mechanism, such as, engaging mechanism 122, 132, 142, 152, in towards the opening, such as, opening 314, 324, so that the engaging mechanism 122, 132, 142, 152, could securely locate and settle within the opening, such as, the opening 314, 324.

Figure 26:
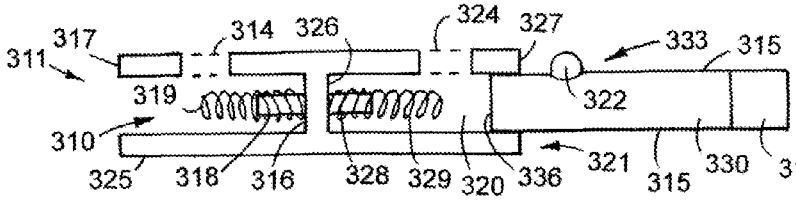
FIG. 26 illustrates a side-view of a twenty-sixth embodiment of a lock-in cosmetic accessory sleeve invention.

FIG. 26 illustrates a side cut-away view of a twenty-sixth embodiment of a lock-in cosmetic accessory sleeve invention or apparatus 333. The lock-in cosmetic accessory sleeve invention 333, is similar to lock-in cosmetic, accessory sleeve invention or apparatus 323, shown in FIG. 24, but this embodiment further shows at least one cosmetic accessory or container 330, being engageably inserted into one of the openings in the lock-in cosmetic accessory sleeve 325, such as, opening 321. The cosmetic accessory or container 330, is similar to the containers discussed earlier, such as, for example, container 10, 20, 30, 120, 130, 140, 150, 160, 170, 180, 190, 200, 210, 220, 230. The cosmetic accessory or container 330, is shown here with a cap 312, and at least one engaging mechanism 322. The at least one engaging mechanism 322, is spring-loaded and protrudes out of the outer surface 315, of the cosmetic accessory 330. Preferably, the spring-loaded engaging mechanism 322, moves substantially vertical to the plane of the outer surface 315, of the cosmetic accessory 330. When pushed down the spring-loaded engaging mechanism 322, moves down inside the cosmetic accessory 330, and temporarily can be substantially parallel to the plane of the outer surface 315, of the cosmetic accessory 330. It is preferred that the at least one engaging mechanism 322, locates and securely settles within an opening of the sleeve 325, such as, the opening 314, 324. One the at least one cosmetic accessory or container 330, has been engageably inserted into one of the openings in the lock-in cosmetic accessory sleeve 325, and is being securely held inside the lock-in cosmetic accessory sleeve 325, the at least one cosmetic accessory or container 330, when desired, can be removed from the lock-in cosmetic accessory sleeve 325, by simply pressing down on the spring-loaded engaging mechanism 322, and moving it down inside the cosmetic accessory 330, and then slideably moving it towards the open end 311, 321, and separating the at least one cosmetic accessory or container 330, from the lock-in cosmetic accessory sleeve 325, as the at least one spring 319, 329, exerts spring-pressure against the base 336, of the at least one cosmetic accessory or container 330, to move it towards the open end 321.

Figure 27:
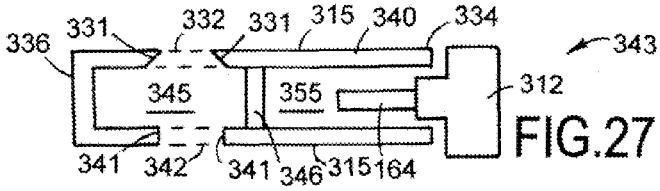
FIG. 27 illustrates a side-view of a twenty-seventh embodiment of a cosmetic accessory sleeve invention.

FIG. 27 illustrates a side cut-away view of a twenty-seventh embodiment of a lock-in cosmetic accessory sleeve invention 343, comprising a cosmetic accessory or container 340, having a closed end or wall or base 336, and an opening or mouth 334, to accommodate a cover or cap or lid 312. The cosmetic accessory 340, is similar to the cosmetic accessory 10, 20, 30, 120, 130, 140, 150, 160, 170, 180, 190, 200, 210, 220, 230, except that it has at least one first chamber 345, and at least one second chamber 355, and wherein the first chamber 345, is separated from the second chamber 355, via at least one wall or barrier or partition 346. The at least one first chamber 345, has at least one first opening 342, having walls 341, and at least one second opening 332, having walls 331. Optionally, the cap or lid 312, could have secured thereto at least one cosmetic accessory 164. It is preferred that the at least one cosmetic accessory 164, faces the partition or wall 346, and is fully contained inside the second chamber 355.

Figure 28:
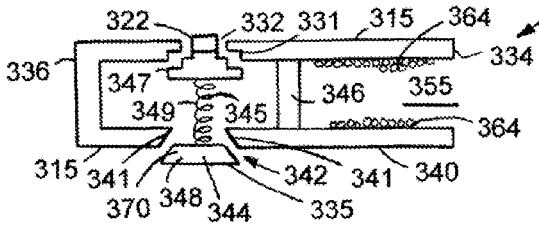
FIG. 28 illustrates a side-view of a twenty-eighth embodiment of a lock-in cosmetic accessory sleeve invention.

FIG. 28 illustrates a side cut-away view of a twenty-eighth embodiment of a lock-in cosmetic accessory sleeve invention 353, comprising a cosmetic accessory or container 340, having a closed end or wall or base 336, and an opening or mouth 334, to accommodate a cover or cap or lid 312. The cosmetic accessory 340, is similar to the cosmetic accessory 10, 20, 30, 120, 130, 140, 150, 160, 170, 180, 190, 200, 210, 220, 230, except that it has at least one first chamber 345, and at least one second chamber 355, and wherein the first chamber 345, is separated from the second chamber 355, via at least one wall or harrier or partition 346. The at least one first chamber 345, has at least one first opening 342, having walls 341, and at least one second opening 332, having, walls 331. Optionally, the cap or lid 312, (not shown) could be secured to mouth 334, to keep the at least one cosmetic accessory contents 364, contained inside the second chamber 355. At least one engageable fastener 370, having an engageable button 322, with walls 347, which is connected to a base 344, having walls 348, via at least one spring means 349, is inserted into the first chamber 345, via the first opening 342, such that the engageable button 322, protrudes out of the second opening 332, while the surfaces 331, and 347, are in engageable contact with each other. The base 344, is pushed into the first opening 342, such that the at least one spring means 349, is in compression, and the wall surfaces 341, and 348, are in secure contact with each other. It is preferred that when the base 344, is secured inside the opening 342, that the base outer surface 335, is parallel or flush with the outer surface 315, of the cosmetic accessory or container's outer surface 315.

Figure 29:
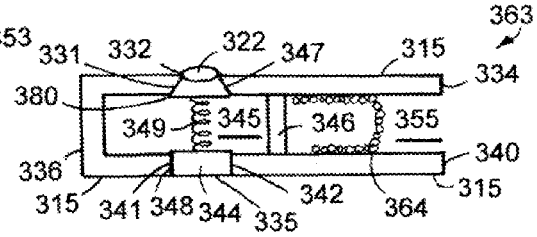
FIG. 29 illustrates a side-view of as twenty-ninth embodiment of a lock-in cosmetic accessory sleeve invention.

FIG. 29 illustrates a side cut-away view of a twenty-ninth embodiment of a lock-in cosmetic accessory sleeve invention 363, comprising a cosmetic accessory or container 340, having a closed end or wall or base 336, and an opening or mouth 334, to accommodate a cover or cap or lid 312. The cosmetic accessory 340, is similar to the cosmetic accessory 10, 20, 30, 120, 130, 140, 150, 160, 170, 180, 190, 200, 210, 220, 230, except that it has at least one first chamber 345, and at least one second chamber 355, and wherein the first chamber 345, is separated from the second chamber 355, via at least one wall or barrier or partition 346. The at least one first chamber 345, has at least one first opening 342, having walls 341, and at least one second opening 132, having walls 331. Optionally, the cap or lid 312, (not shown) could be secured to mouth 334, to keep the at least one cosmetic accessory contents 364, contained inside the second chamber 355. At least one engageable fastener 380, having an engageable button 322, with walls 347, which is connected to a base 344, having walls 348, via at least one spring, means 349, is inserted into the first chamber 345, via the first opening 342, such that the engageable button 322, protrudes out of the second opening 332, while the surfaces 331, and 347, are in engageable contact with each other. The base 344, is pushed into the first opening 342, such that the at least one spring means 349, is in compression, and the wall surfaces 341, and 348, are in secure contact with each other. It is preferred that when the base 344, is secured inside the opening 342, that the base outer surface 335, is parallel or flush with the outer surface 315, of the cosmetic accessory or container's outer surface 315.

Figure 30:
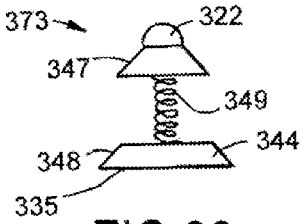
FIG. 30 illustrates a side-view of a thirtieth embodiment of a lock-in cosmetic accessory sleeve invention.

FIG. 30 illustrates a side-view of a thirtieth embodiment of a lock-in cosmetic accessory sleeve invention illustrating at least one engageable fastener 373. The engageable fastener 373, has an engageable button 322, with walls 347, which are connected to a base 344, having walls 348, via at least one spring means 349. As shown in FIGS. 28 and 29, that the engageable fastener 373, can be inserted into the first chamber 345, via the first opening 342, such that the engageable button 322, protrudes out of the second opening 332, while the surfaces 331, and 347, are in engageable contact with each other. Additionally, when the base 344, is pushed into the first opening 342, the spring means 349, is then pushed into a compression mode, and the wall surfaces 341, and 348, are secured to each other so that the button is forced to protrude through the second opening 332. It is preferred that when the base 344, is secured inside the opening 342, that the base outer surface 335, is parallel or flush with the outer surface 315, of the cosmetic accessory or container's outer surface 315.

Figure 31:
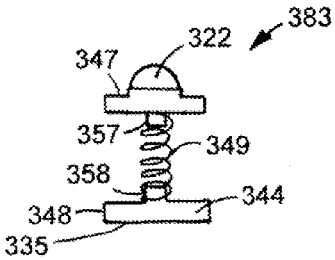
FIG. 31 illustrates a side-view of a thirty-first embodiment of a lock-in cosmetic accessory sleeve invention.

FIG. 31 illustrates a side-view of a thirty-first embodiment of a lock-in cosmetic accessory sleeve invention illustrating at least one engageable fastener 381. The engageable fastener 383, has an engageable button 322, with walls 347, which are connected to a base 344, having walls 348, via at least one spring means 349. Optionally, the base 344, could have at least one stub or protrusion or male portion 358, to securely engage and accommodate one end of the spring means 349. Optionally, the base of the engageable button 322, could have at least one stub or protrusion or male portion 357, to securely engage and accommodate one end of the spring means 349. As shown in FIGS. 28 and 29, that the engageable fastener 373, can be inserted into the first chamber 345, via the first opening 342, such that the engageable button 322, protrudes out of the second opening 332, while the surfaces 331, and 347, are in engageable contact with each other. Additionally, when the base 344, is pushed into the first opening 342, the spring means 349, is then pushed into a compression mode, and the wall surfaces 341, and 348, are secured to each other so that the button is forced to protrude through the second opening 332. It is preferred that when the base 344, is secured inside the opening 342, that the base outer surface 335, is parallel or flush with the outer surface 315, of the cosmetic accessory or container's outer surface 315.

Figure 32:
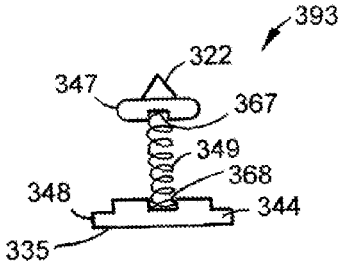
FIG. 32 illustrates a side-view of a thirty-second embodiment of a lock-in cosmetic accessory sleeve invention.

FIG. 32 illustrates a side-view of a thirty-second embodiment of a lock-in cosmetic accessory sleeve invention illustrating at least one engageable fastener 393. The engageable fastener 393, has an engageable button 322, with walls 347, which are connected to a base 344, having walls 348, via at least one spring means 349. Optionally, the base 344, could have at least one blind hole or area or female portion 368, to securely engage and accommodate one end of the spring means 349. Optionally, the base of the engageable button 322, could have at least one blind hole or area or female portion 367, to securely engage and accommodate one end of the spring means 349. As shown in FIGS. 28 and 29, that the engageable fastener 373, can be inserted into the first chamber 345, via the first opening 342 such that the engageable button 322, protrudes out of the second opening 332, while the surfaces 331, and 347, are in engageable contact with each other. Additionally, when the base 344, is pushed into the first opening 342, the spring means 349, is then pushed into a compression mode, and the wall surfaces 341, and 348, are secured to each other so that the button is forced to protrude through the second opening 332. It is preferred that when the base 344, is secured inside the opening 342, that the base outer surface 335, is parallel or flush with the outer surface 315, of the cosmetic accessory or container's outer surface 315.

It is preferred that the periphery of the wall 331, of the cosmetic accessory or container 330, 340, is shaped so as to complement the shape of periphery of the wall 347, of the engageable button 322. In order to contain the engageable button 322, from slipping out of the opening 332, it is preferred that the peripheral wall 331, is at its narrowest along the outer surface 315, and widest inside the chamber 345. Similarly, it is preferred that the periphery of the wall 341, of the cosmetic accessory or container 330, 340, is shaped so as to complement the shape of periphery of the wall 348, of the base 344, of the engageable fastener 370, 380, 373, 383, 393.

It is preferred that the lock-in cosmetic accessory sleeve is made from a material selected from a group comprising, metal, plastic, glass, Plexiglas, a composite material, or any combination thereof, to name a few.

It is preferred that the cosmetic accessory is made from a material selected from a group comprising, metal, plastic, glass, Plexiglas, a composite material, or any combination thereof, to name a few. For most applications the cosmetic accessory is preferably a slender and an elongated type cosmetic accessory. For some applications the cosmetic accessory could be made from a transparent material or at least a portion of the cosmetic accessory could be transparent so that the user could visually see the material remaining inside the cosmetic accessory.

The cosmetic accessory could contain material from a group comprising, a brush, a swab, a cosmetic stick, a lip gloss stick, a perfume stick, a cologne stick, a deodorant stick, an antiperspirant stick, an after shave, a shadow pencil, a cosmetic lacquer liner, a mascara liner, a stain remover stick, a blush stick, a roll-on hall, a lipstick, a lip gloss, a chap stick, a perfume, a cologne, a breath freshener, a breath spray, a deodorant, an antiperspirant, an eyeliner, an eye shadow, a cosmetic-type pencil, an eye shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, a makeup foundation, and combinations thereof, to name a few. The cosmetic accessory could also be a hollow container which could be used as a storage container or device as desired by the user. Similarly, the cosmetic accessory could also be a refillable container or dispenser. However, for some applications the cosmetic accessory could be such that it accommodates a removable or replaceable fluid or material reservoir cartridge. For some applications the cosmetic accessory could be a pen-type insert which could be engageably or permanently inserted within a casing.

It is preferred that the lock-in cosmetic accessory sleeve apparatus is used to secure two complimentary cosmetic items within the sleeve or carrier. For example, the first cosmetic accessory 10, could be a breath spray 10, while the second cosmetic accessory 20, could be a lip gloss 20, which could both engageably be secured to the lock-in cosmetic accessory sleeve or carrier 25.

As one can now appreciate that this invention allows the easy carrying of small cosmetic accessories in a secure and engageably removable way, such as, in a purse or a pouch or in a pocket.

For some applications one could color code the lock-in cosmetic accessory sleeve and/or the containers and/or the cosmetic accessory containers. One could also use glitter and/or rhinestones with the lock-in cosmetic accessory sleeve and/or the containers and/or the cosmetic accessory containers.

The lock-in cosmetic accessory sleeve apparatus of this invention is being marketed under the brand name "Freshkiz", and is available via the website www.freshkiz.com.

The cap on the cosmetic accessory is preferably used to protect the dispensing means, however, for some applications an article could be secured to the cap such that the article secured to the cap is held inside the container, and wherein the article could be selected from a group comprising a brush, a swab, cosmetic stick, a lipstick, a lip gloss stick, a chap stick, a perfume stick, a cologne stick, a deodorant stick, an antiperspirant stick, an eyeliner, an eye shadow pencil, a cosmetic-type pencil, a shadow pencil, a concealer pencil, a liquid liner, a lip liner, a cosmetic lacquer liner, a mascara liner, a stain remover stick, and a blush stick, a roll-on ball, to name a few.

It should be appreciated that for most applications the cross-sectional area of the lock-in cosmetic accessory sleeve is larger than the cross-sectional area of the first container and/or the second container.

The peripheral shape of the engageable button 322, is selected from a group comprising a round-shaped button, a square-shaped button, an elliptical-shaped button, a conical-shaped button, an odd-shaped button, a triangular-shaped button, a polygonal-shaped button, to name a few.

The peripheral shape of the wall 331, is selected from a group comprising, a triangular shape, a stepped shape, a conical shape, a curved shape, an arced shape, to name a few.

While the present invention has been particularly described in conjunction with a specific preferred embodiment, it is evident that many alternatives, modifications and variations will be apparent to those skilled in the at in light of the foregoing description it is therefore contemplated that the appended claims will embrace any such alternatives, modifications and variations as falling within the true scope and spirit of the present invention.

What is claimed is:

1. A lock-in cosmetic accessory sleeve apparatus comprising:

(a) a cosmetic accessory having at least one first engageable means, said cosmetic accessory comprising a container, said container having at least one dispensing means for the passage of at least one first material, and wherein at least a portion of said cosmetic accessory is releaseably secured to at least a portion of an inner wall of a lock-in cosmetic accessory sleeve through an open end;

(b) at least one inner wall between said at least one dispensing means and a base of said cosmetic accessory, and forming a chamber, said chamber having at least one first opening, and at least one second opening, and wherein said first opening being directly opposite said second opening; and (c) at least one engageable fastener, and wherein said engageable fastener having an engageable button connected to an engageable base via at least one spring-like means, and wherein said engageable button is securely and engageable secured within said first opening in said chamber, and wherein said engageable base is secured within said second opening in said chamber, such that said engageable button forms said at east one first engageable means.

2. The lock-in cosmetic accessory sleeve apparatus of claim 1, wherein said engageable button comprises an upper portion and a base portion, and wherein at least a portion of said upper portion protrudes out of said first opening.

3. The lock-in cosmetic accessory sleeve apparatus of claim 1, wherein said engageable button comprises an upper portion and a base portion, and wherein at least a portion of said upper portion protrudes out of said first opening, and wherein the cross-sectional shape of said engageable button is selected from a group consisting of a circular shape, an elliptical shape, a triangular shape, and a polygonal shape.

4. The lock-in cosmetic accessory sleeve apparatus of claim 1, wherein said engageable button comprises an upper portion and a base portion, and wherein at least a portion of said upper portion protrudes out of said first opening, and wherein said base portion has at least one means to engageably be secured to a wall surface of said first opening.

5. The lock-in cosmetic accessory sleeve apparatus of claim 1, wherein said engageable base comprises at least one engageable means to securely be secured to a wall surface of said second opening, such that a bottom portion of said engageable base is substantially in the same plane as the plane of an outer surface of said cosmetic accessory.

6. The lock-in cosmetic accessory sleeve apparatus of claim 1, wherein at least one of said at least one first material and said at least one second material is selected from a group consisting of a brush, a swab, a cosmetic stick, a lip gloss stick, a perfume stick, a cologne stick, a deodorant stick, an antiperspirant stick, an after shave, a shadow pencil, a cosmetic lacquer liner, a mascara liner, a stain remover stick, a blush stick, a roll-on ball, a lipstick, a lip gloss, a chap stick, a perfume, a cologne, a breath freshener, a breath spray, a deodorant, an antiperspirant, an eyeliner, an eye shadow, a cosmetic-type pencil, an eye shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, a makeup foundation, and combinations thereof.

7. The lock-in cosmetic accessory sleeve apparatus of claim 1, wherein said at least one sleeve engageable means is selected from a group consisting of a locking thread, a locking channel, a bayonet type channel, a locking ridge, a ball-bearing, a male-type protrusion, a female-type recess, a locking teeth, a locking rib, a locking bump, a spring-loaded engagement means, and combinations thereof.

8. The lock-in cosmetic accessory sleeve apparatus of claim 1, wherein at least one of said at least one first and second engageable means is selected from a group consisting of a locking thread, a locking channel, a bayonet type channel, a locking ridge, a ball-bearing, a male-type protrusion, a female-type recess, a locking teeth, a locking rib, a locking bump, a spring-loaded engagement means, and combinations thereof.

9. The lock-in cosmetic accessory sleeve apparatus of claim 1, wherein said lock-in cosmetic accessory sleeve is made from a material selected from a group consisting of metal, plastic, glass, Plexiglas, a composite material, and combination thereof.

10. The lock-in cosmetic accessory sleeve apparatus of claim 1, wherein at least one of said first and second container is made from a material selected from a group consisting of metal, plastic, glass, Plexiglas, a composite material, and combination thereof.

11. A lock-in cosmetic accessory sleeve apparatus comprising:

(a) a lock-in cosmetic accessory sleeve having a first open end and a second open end, at least one inner wall between said first open end and said second open end, an outer wall, and at least one sleeve engageable means;

(b) a first cosmetic accessory having at least one first engageable means, said first cosmetic accessory comprising, a first container, said first container having, a first dispensing means for the passage of at least one first material, and wherein at least a portion of said first cosmetic accessory is releaseably secured to at least a portion of said inner wall of said lock-in cosmetic accessory sleeve through said first open end;

(c) a second cosmetic accessory having at least one second engageable means, said second cosmetic accessory comprising a second container, said second container having a second dispensing means for the passage of at least one second material, and wherein at least a portion of said second cosmetic accessory is releaseably secured to at least a portion of said inner wall of said lock-in cosmetic accessory sleeve through said second open end;

(d) wherein said at least one sleeve engageable means engages said at least one first engageable means to securely engage said first cosmetic accessory to said lock-in cosmetic accessory sleeve, and said at least one sleeve engageable means engages said at least one second engageable means to securely engage said second cosmetic accessory to said lock-in cosmetic accessory sleeve;

(e) said at least one inner wall between said first open end and said second open end having at least one first protrusion facing said first open end, and wherein said first protrusion having at least one first spring-like means;

(f) at least one inner wall between said at least one dispensing means and a base of said first cosmetic accessory, and forming at least one first chamber, said first chamber haying at least one first chamber opening, and at least one second chamber opening, and wherein said first chamber opening is directly opposite said second chamber opening; and (g) at least one engageable fastener, and wherein said engageable fastener having an engageable button connected to an engageable base via at least one spring-like means, and wherein said engageable button is securely and engageable secured within said first chamber opening, in said chamber, and wherein said engageable base is secured within said second chamber opening in said chamber, such that said engageable button forms said at least one first engageable means.

12. The lock-in cosmetic accessory sleeve apparatus of claim 11, wherein said engageable button comprises an upper portion and a base portion, and wherein at least a portion of said upper portion protrudes out of said first opening.

13. The lock-in cosmetic accessory sleeve apparatus of claim 11, wherein said engageable button comprises an upper portion and a base portion, and wherein at least a portion of said upper portion protrudes out of said first opening, and wherein the cross-sectional shape of said engageable button is selected from a group consisting of a circular shape, an elliptical shape, a triangular shape, and a polygonal shape.

14. The lock-in cosmetic accessory sleeve apparatus of claim 11, wherein said engageable button comprises an upper portion and a base portion, and wherein at least a portion of said upper portion protrudes out of said first opening, and wherein said base portion has at least one means to engageably be secured to a wall surface of said first opening.

15. The lock-in cosmetic accessory sleeve apparatus of claim 11, wherein said engageable base comprises at least one engageable means to securely be secured to a wall surf of said second opening, such that a bottom portion of said engageable base is substantially in the same plane as the plane of an outer surface of said cosmetic accessory.

16. The lock-in cosmetic accessory sleeve apparatus of claim 11, wherein at least one of said at least one first material and said at least one second material is selected from a group consisting of a brush, a swab, a cosmetic stick, a lip gloss stick, a perfume stick, a cologne stick, a deodorant stick, an antiperspirant stick, an after shave, a shadow pencil, a cosmetic lacquer liner, a mascara liner, a stain remover stick, a blush stick, a roll-on ball, a lipstick, a lip gloss, a chap stick, a perfume, a cologne, is breath freshener, a breath spray, a deodorant, an antiperspirant, all eyeliner, an eye shadow, a cosmetic-type pencil, an eye shadow pencil, a concealer pencil, a liquid liner, a lip liner, a cosmetic lacquer, a mascara, a cream, a hand cream, an acne cream, a lotion, a suntan lotion, a skin lotion, a cosmetic fluid, a nail polish, a nail polish remover, a stain remover, a static guard, a blush, a powder, a mineral powder, a makeup concealer, a makeup foundation, and combinations thereof.

17. The lock-in cosmetic accessory sleeve apparatus of claim 11, wherein said at least one sleeve engageable means is selected from a group consisting of a locking thread, a locking channel, a bayonet type channel, a locking ridge, a ball-bearing, a male-type protrusion, a female-type recess, a locking teeth, a locking rib, a locking bump, a spring-loaded engagement means, and combinations thereof.

18. The lock-in cosmetic accessory sleeve apparatus of claim 11, wherein at least one of said at least one first and second engageable means is selected from a group consisting, of a locking thread, a locking channel, a bayonet type channel, a locking ridge, a ball-bearing, a male-type protrusion, a female-type recess, a locking teeth, a locking rib, a locking bump, a spring-loaded engagement means, and combinations thereof.

19. The lock-in cosmetic accessory sleeve apparatus of claim 11, wherein said lock-in cosmetic accessory sleeve is made from a material selected from a group consisting of metal, plastic, glass, Plexiglas, a composite material, and combination thereof.

20. The lock-in cosmetic accessory sleeve apparatus of claim 11, wherein at least one of said first and second container is made from a material selected from a group consisting of metal, plastic, glass, Plexiglas, a composite material, and combination thereof.

* * * * *